US008500037B2

(12) United States Patent
Li et al.

(10) Patent No.: US 8,500,037 B2
(45) Date of Patent: Aug. 6, 2013

(54) ADJUSTABLE WATER JET DEVICE

(75) Inventors: H. Charles Li, Peachtree City, GA (US); Bill Drury, Peachtree City, GA (US); Zachary Vogtner, Atlanta, GA (US)

(73) Assignee: Custom Molded Products, Inc., Newnan, GA (US)

( * ) Notice: Subject to any disclaimer, the term of this patent is extended or adjusted under 35 U.S.C. 154(b) by 598 days.

(21) Appl. No.: 12/775,106

(22) Filed: May 6, 2010

(65) Prior Publication Data

US 2011/0272498 A1 Nov. 10, 2011

(51) Int. Cl.
*B05B 17/08* (2006.01)

(52) U.S. Cl.
USPC ..... 239/17; 239/16; 239/201; 239/465; 239/569; 239/580; 239/587.4; 239/600

(58) Field of Classification Search
USPC ..... 239/16, 17, 22, 457, 465, 513, 537, 239/538, 569, 580, 581.1, 587.4, 600, 201, 239/589
See application file for complete search history.

(56) References Cited

U.S. PATENT DOCUMENTS

| | | | | |
|---|---|---|---|---|
| 1,724,662 | A * | 8/1929 | Johnson | 239/513 |
| 1,917,216 | A | 7/1933 | Bersted | |
| 1,942,395 | A | 1/1934 | Bersted | |
| 3,081,040 | A * | 3/1963 | Hartmann | 239/600 |
| 4,189,099 | A * | 2/1980 | Bruninga | 239/580 |
| 7,770,815 | B2 * | 8/2010 | Green et al. | 239/580 |
| 2007/0290078 | A1 | 12/2007 | Green et al. | |

* cited by examiner

*Primary Examiner* — Steven J Ganey
(74) *Attorney, Agent, or Firm* — Laurence P. Colton; Smith Risley Tempel Santos LLC

(57) ABSTRACT

An adjustable water jet device that allows for the arc of the jet of water to be adjusted while the water is still flowing through the device. A multipurpose tool is disclosed which has a central hollow cavity surrounded by a grip. The multipurpose tool can be used to adjust the arc of the water jet, allowing the water to flow through the central hollow cavity of the tool. The multipurpose tool can also be used to adjust the flow rate of water through the device and to disassemble the device for maintenance purposes.

22 Claims, 11 Drawing Sheets

ADJUSTABLE WATER JET DEVICE

BACKGROUND OF THE INVENTION

1. Technical Field

The invention is generally related to water jet devices for sending a stream or arc of water into a water feature, and is more specifically related to adjustable water jet devices for sending an ornamental stream of water into a spa, pool, artificial pond, or other water feature.

2. Prior Art.

Water jet devices are used in ornamental fountains, pools, or other bodies of water to create a spout of water that travels up in the air a certain distance, usually in an arc. Such water jet devices may utilize a system to force water under high pressure to achieve a desired vertical height, which then falls into the water feature in an ornamental arc. Water jet devices can be situated at an angle so as to create and control the arc of the water flowing out of the jet. Typically, the angle of a water jet only can be adjusted after the water flowing through the water jet device has been turned off. Thereafter, water flow is restarted and the arc of the water can be observed. If further refinements are desired, the water jet device must once again be turned off to allow the angle of the jet to be readjusted once again. This trial and error process will continue until the desired arc is achieved.

BRIEF SUMMARY OF THE INVENTION

Disclosed herein is an adjustable water jet device that allows for the arc of the jet of water to be adjusted while the water is still flowing through the device. A multipurpose tool is disclosed which has a central hollow cavity surrounded by a grip. The multipurpose tool cooperates with the internal structure of the water jet and can be used to adjust the arc of the water jet while water is flowing through the water jet, by allowing the water to flow through the central hollow cavity of the tool. The multipurpose tool can also be used to adjust the flow rate of water through the water jet device. Accordingly, the arc of the water jet and the flow rate of water through the device can be easily and quickly adjusted without turning off the flow of water through the device.

DETAILED DESCRIPTION OF PREFERRED EMBODIMENTS

Figure 1:
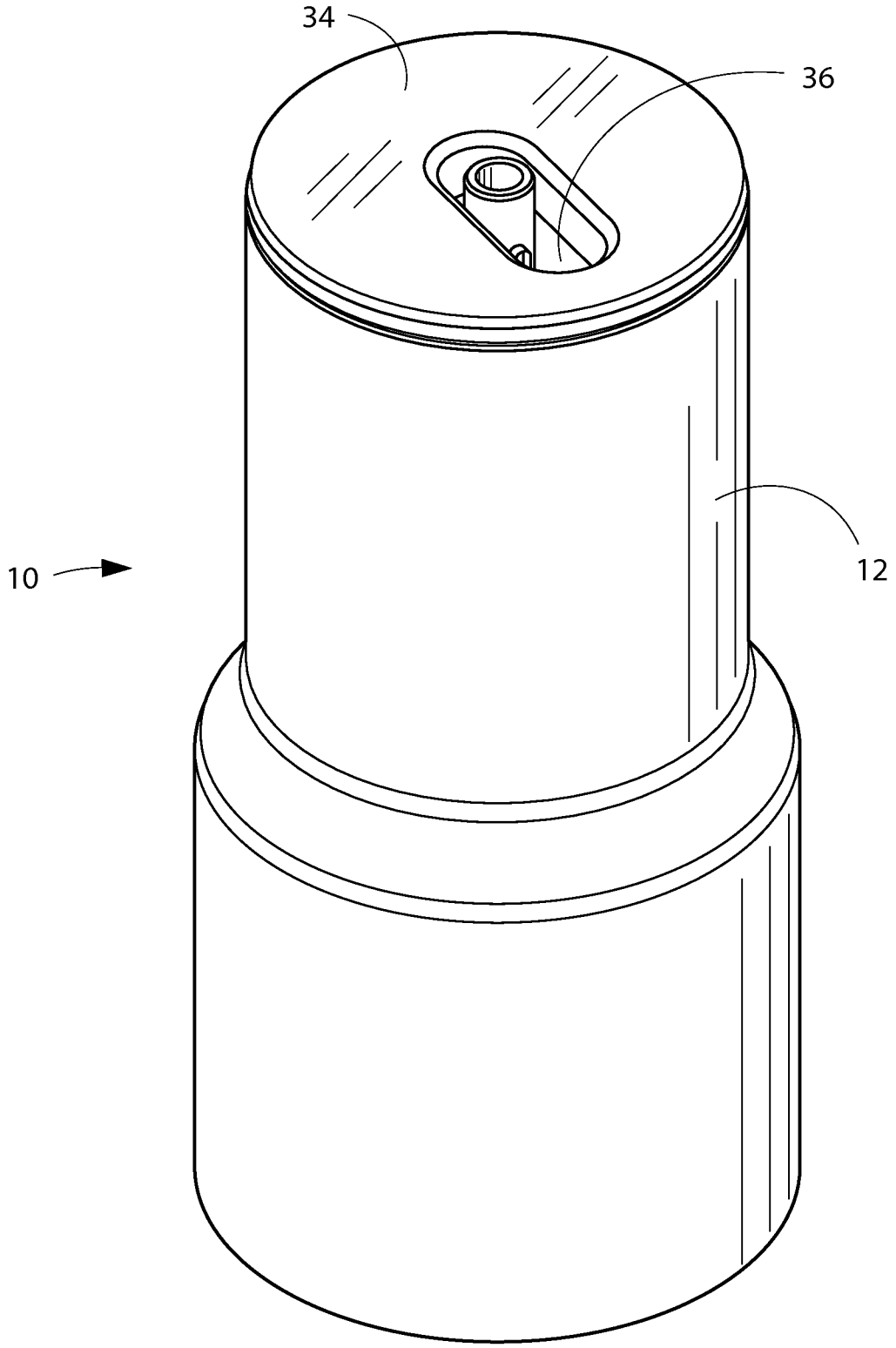
FIG. 1 is a perspective view of an embodiment of an adjustable water jet device according to the present invention.
Figure 2:
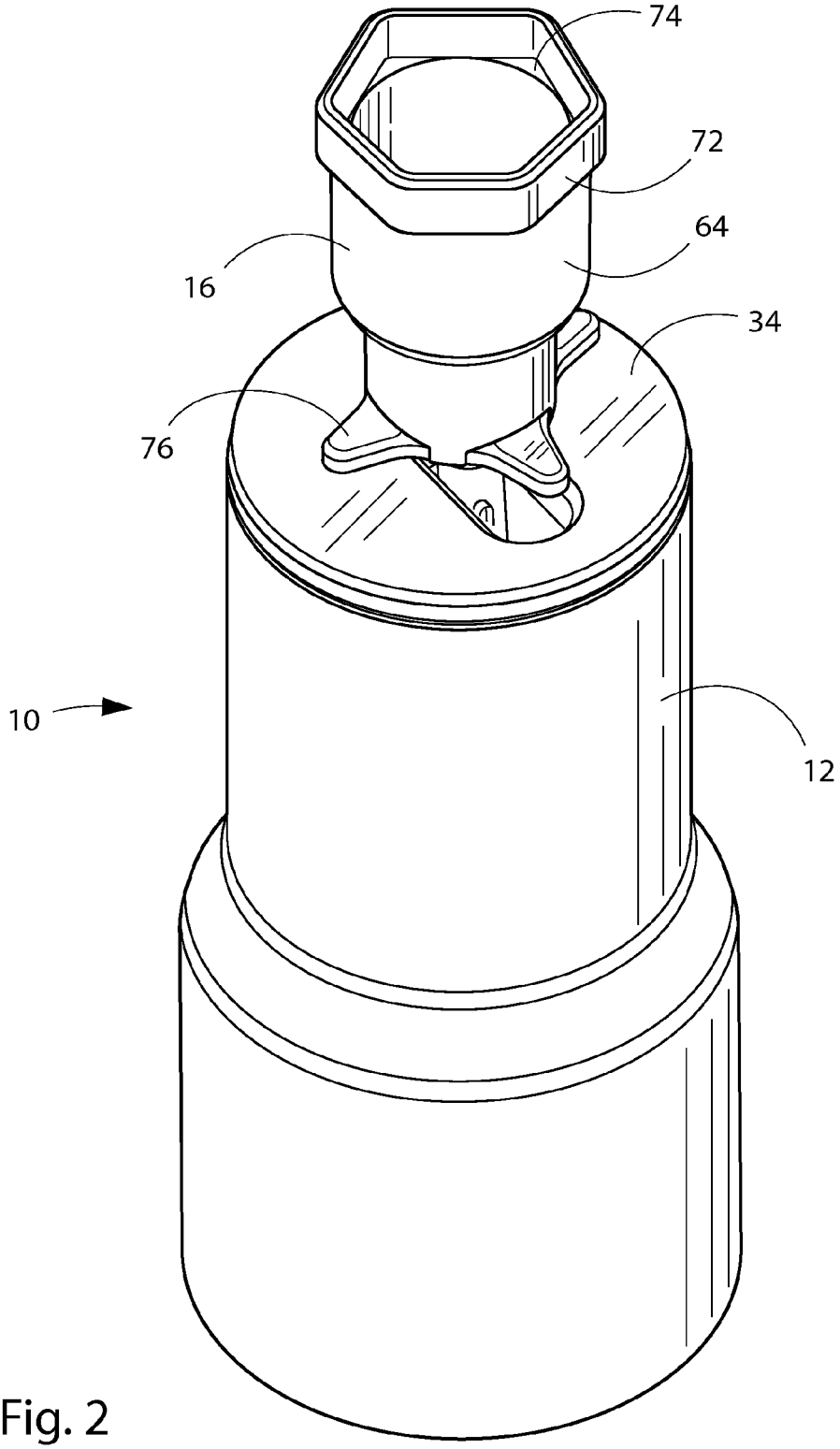
FIG. 2 is a perspective view of the embodiment shown in FIG. 1 with a multipurpose tool engaged with the spout of the adjustable water jet device.
Figure 3:
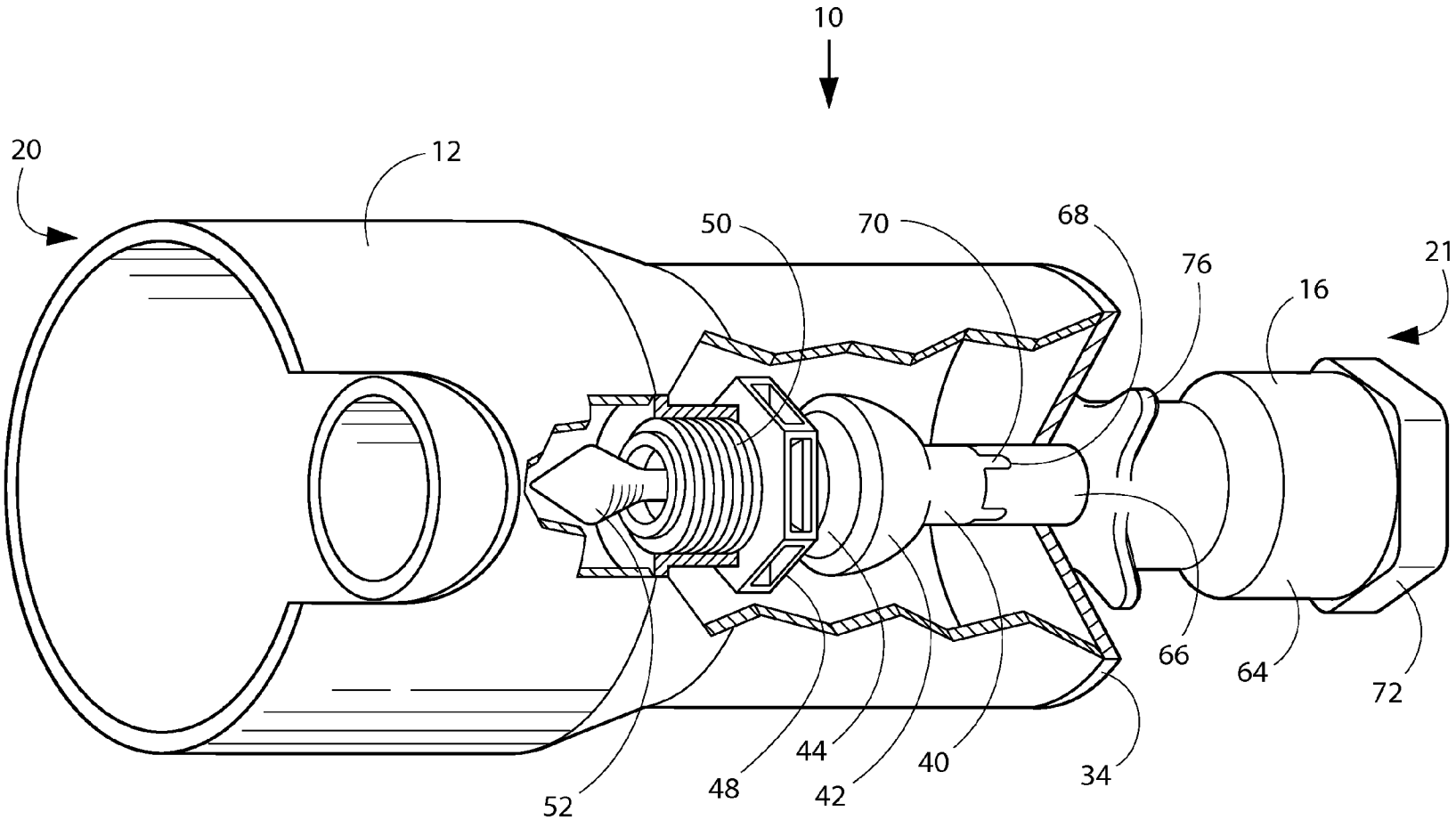
FIG. 3 is a perspective view, partly in section, of the embodiment shown in FIG. 1.
Figure 4:
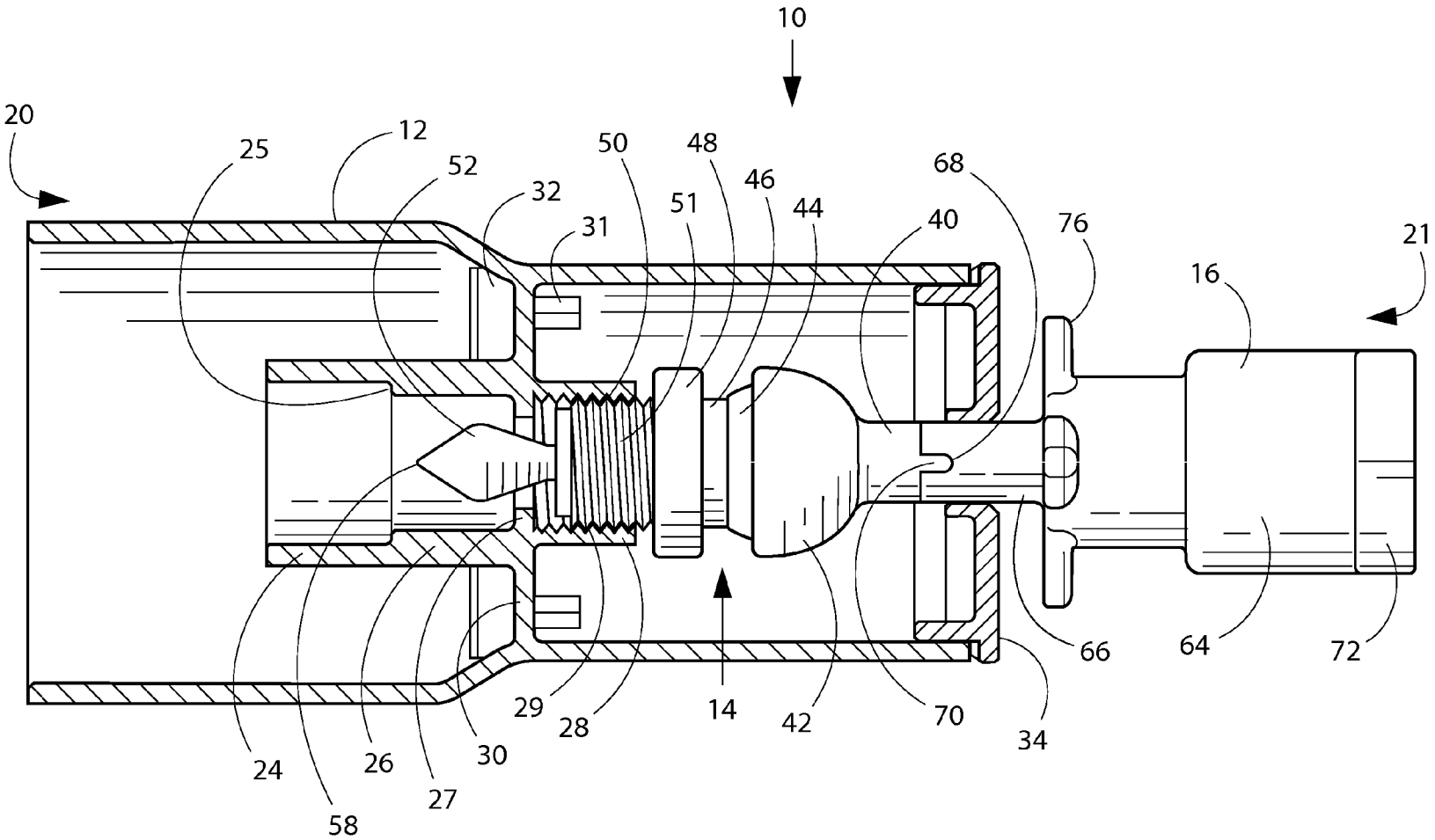
FIG. 4 is a side view, partly in section, of the embodiment shown in FIG. 1.
Figure 5:
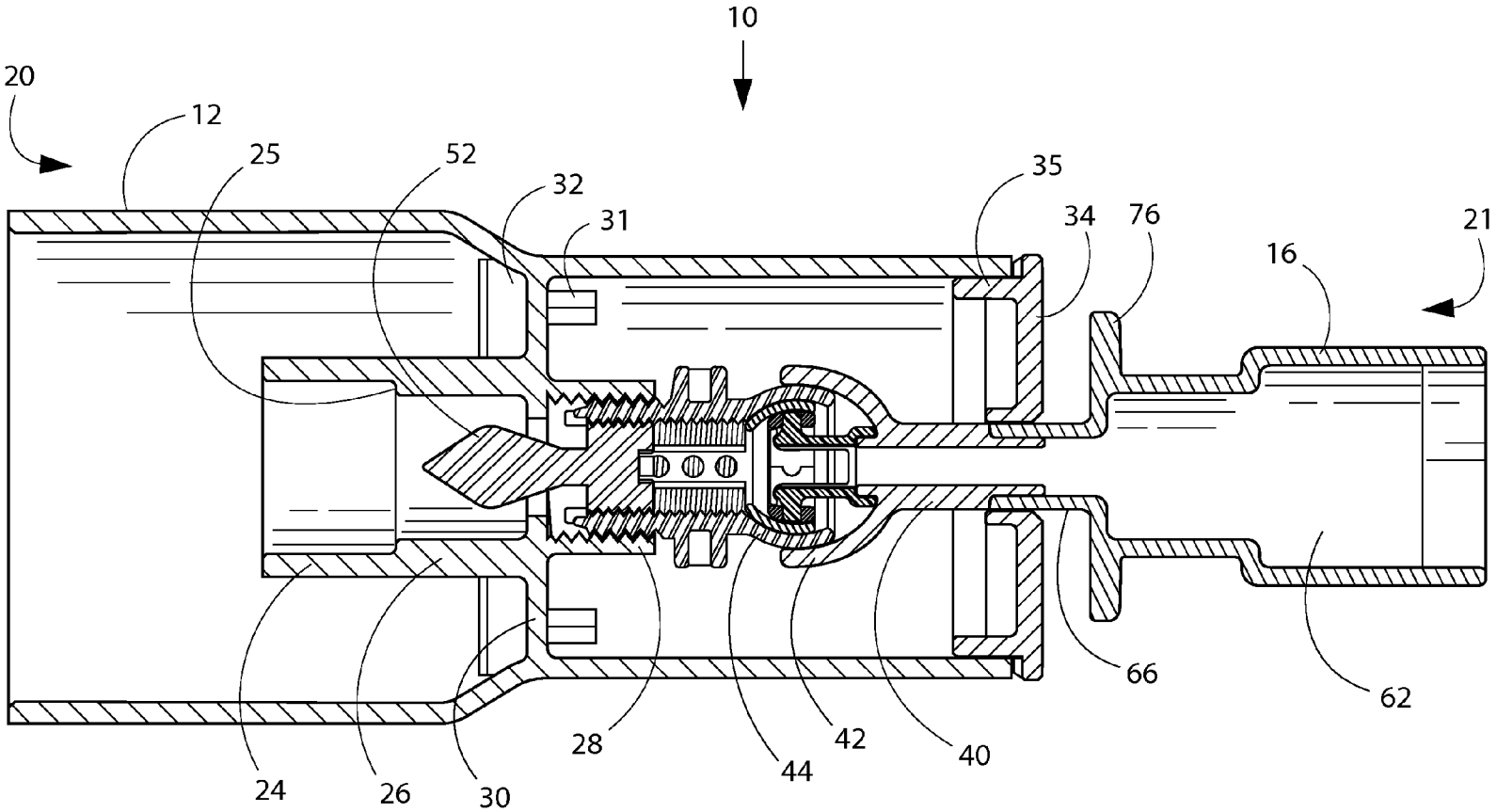
FIG. 5 is a side sectional view of the embodiment shown in FIG. 1.
Figure 6:
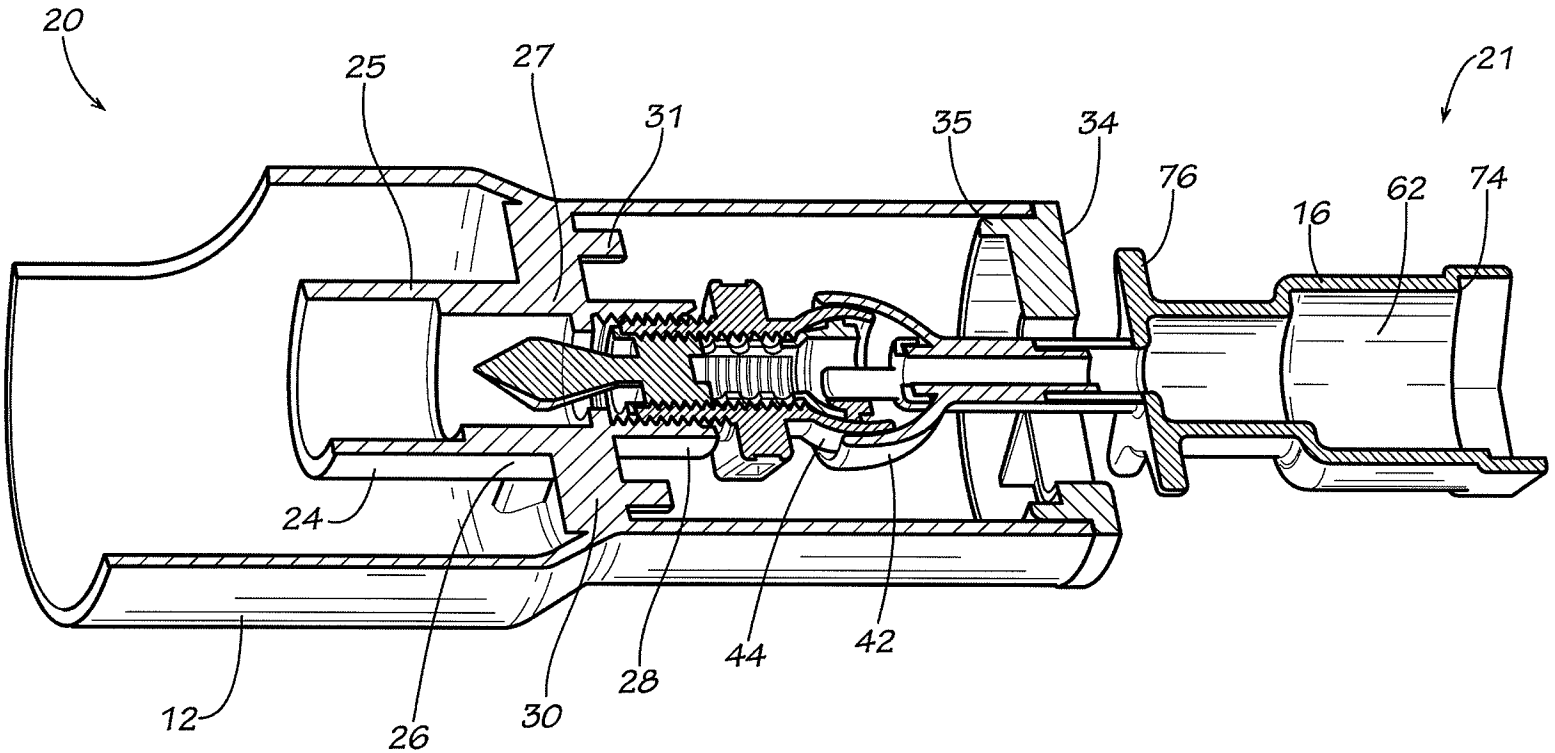
FIG. 6 is a perspective sectional view of the embodiment shown in FIG. 1.
Figure 7:
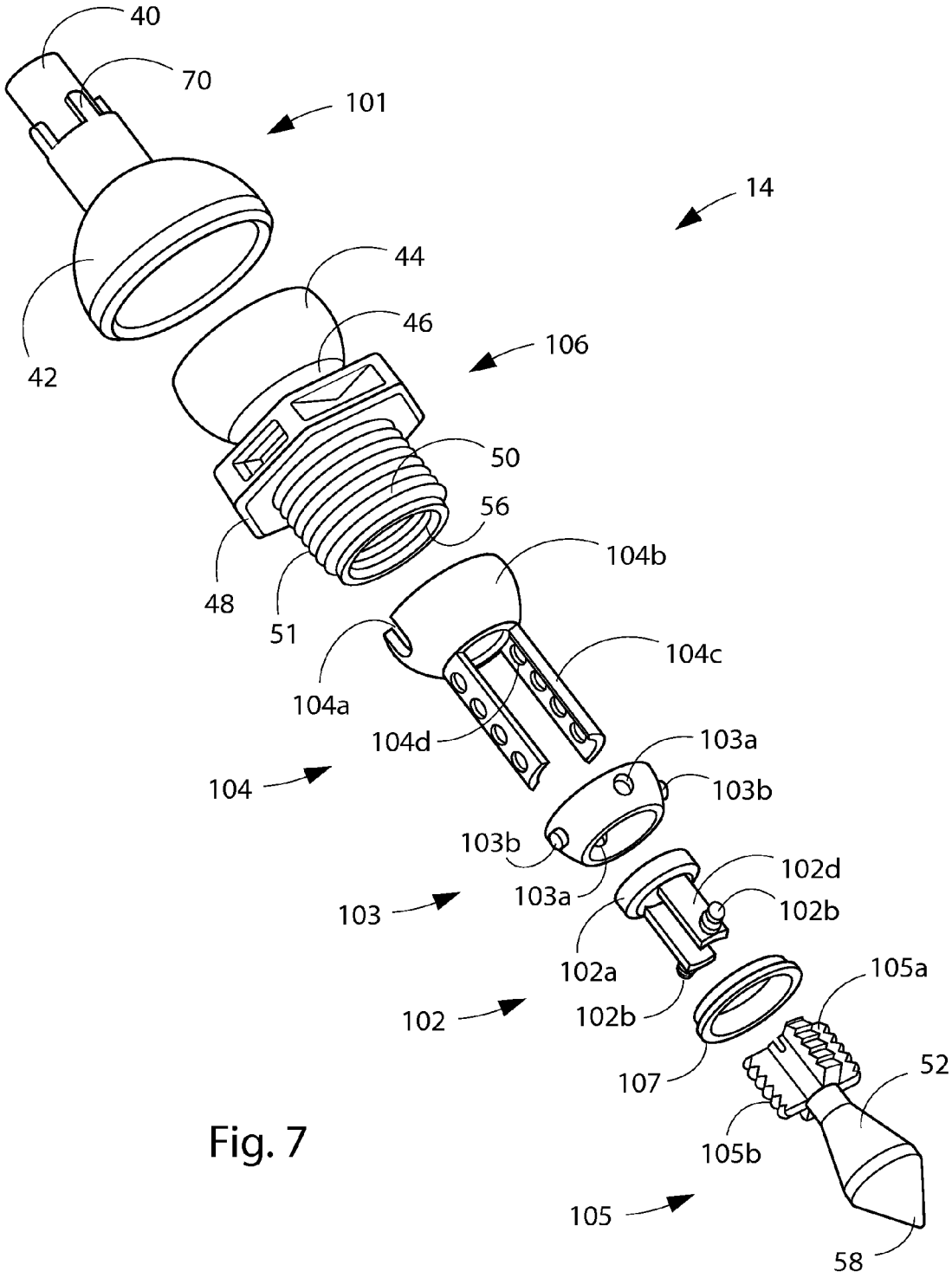
FIG. 7 is an exploded view of the central valve section of the embodiment shown in FIG. 1.
Figure 8:
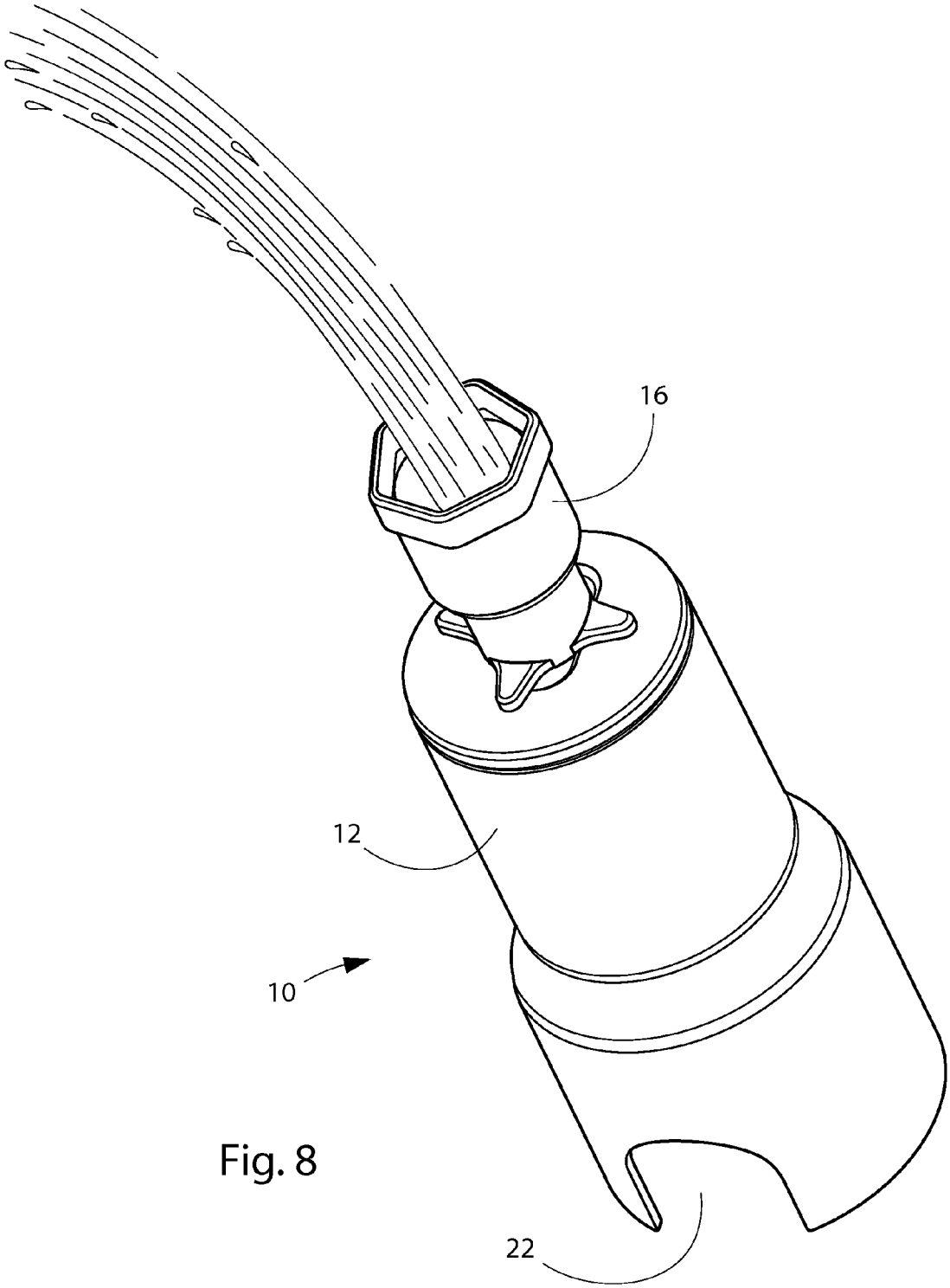
FIG. 8 is a perspective view of the embodiment of FIG. 1 showing water traveling through the water jet device and the multipurpose tool attached thereto.
Figure 9:
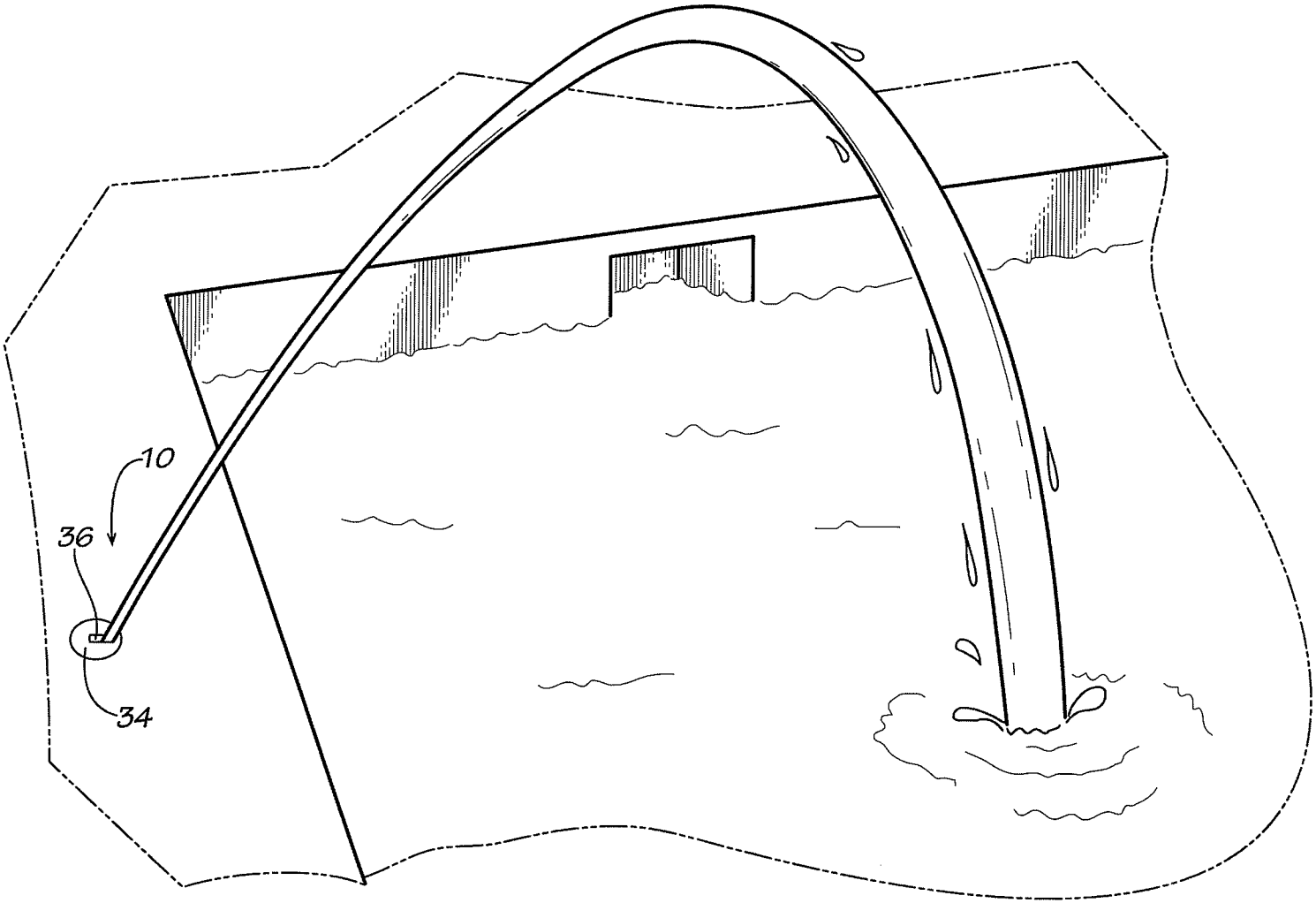
FIG. 9 is a view of the embodiment of FIG. 1 showing the water jet device installed next to a swimming pool.

FIGS. 1-9 illustrate varying views of an embodiment of an adjustable water jet device 10 in which like reference numerals indicate like parts throughout the several views. The adjustable water jet device 10 generally comprises three separate components: a housing 12, a central valve section 14, and a multipurpose tool 16. As shown in FIGS. 1 and 9, the multipurpose tool 16 can be removed from the adjustable water jet device 10 once the desired water flow rate and water arc are achieved. That is, during normal operation, the multipurpose tool 16 is removed from the adjustable water jet device 10 as shown in FIGS. 1 and 9.

Housing 12 preferably comprises a substantially hollow form capable of holding and supporting the central valve section 14 (FIGS. 4, 7) therein. Housing 12 may be formed of any suitable material, including, but not limited to, plastic, wood, ceramic, or stainless steel. Housing 12 and adjustable water jet device 10 generally have a first end 20 and a second end 21. As disclosed herein, the first end 20 may be interchangeably referred to as the "lower end" and the second end 21 may be interchangeably referred to as the "upper end."

Housing 12 may contain an opening 22 (FIG. 8) towards the first end 20 of the adjustable water jet device 10. Opening 22 optionally provides a space for a pipe, hose, or other water supply (not pictured) to enter into housing 12. The pipe or other water supply may be configured to mate with the lower channel portion 24 (FIGS. 4-6) inside of housing 12. Preferably, the outer diameter of the pipe or other water supply will be just slightly less than the inside diameter of the lower channel portion 24, thus allowing the pipe to snugly fit inside the lower channel portion 24. A flange 25 may be provided to separate the lower channel portion 24 from the central channel portion 26. Flange 25 advantageously provides a backstop when inserting a pipe or other water supply into the lower channel portion 24. An optional O-ring (not pictured) may be placed inside the lower channel portion 24 so as to be situated between flange 25 and the inserted pipe. Such an O-ring will advantageously prevent water from leaking out of the lower channel portion 24 towards the first end 20 of the adjustable water jet device 10.

Housing 12 preferably contains a central reinforcing portion 30 (FIGS. 4-6) for supporting the central channel portion 26 and upper channel portion 28. Central reinforcing portion 30 may contain stiffening members 31 and/or ribs 32 for providing internal support. Optional ribs 32 may connect central reinforcing portion 30 to the external walls of the housing 12. Flange 27 preferably separates central channel portion 26 from upper channel portion 28.

A removable cap 34 (FIGS. 1, 4-6) may be provided towards the second end 21 of the adjustable water jet device 10. Removable cap 34 preferably contains an internal lip 35 (FIGS. 4-6) around its internal circumference. Internal lip 35 is preferably just slightly narrower in diameter than the second end 21 of housing 12 so as to allow the removable cap 34 to fit snugly inside the second end 21 of housing 12. As shown in FIGS. 1 and 9, removable cap 34 preferably contains a slot 36 so as to allow the water jet to flow out of housing 12 at a variety of different angles. Removable cap 34 provides for an aesthetically pleasing cover to the housing 12, obscuring the central valve section 14 and other internal parts of the adjustable water jet device 10 from view. Removable cap 34 may contain slots (not pictured) at various points around its upper edge to allow the use of a screwdriver or other device to aid in prying the removable cap 34 from the second end 21 of the housing 12.

The central valve section 14 (FIGS. 3-7) preferably is situated inside the housing 12 to control the water pressure and the angle of the water jet flowing through the adjustable water jet device 10. As shown in FIG. 7, the central valve section 14 preferably comprises seven components: an upper portion 101, an upper connector 102, a lower connector 103, a middle portion 104, a valve portion 105, a lower portion 106, and a molded ring 107. Each of these seven components has a channel or central opening to allow water to flow through the central valve section 14.

Figure 10:
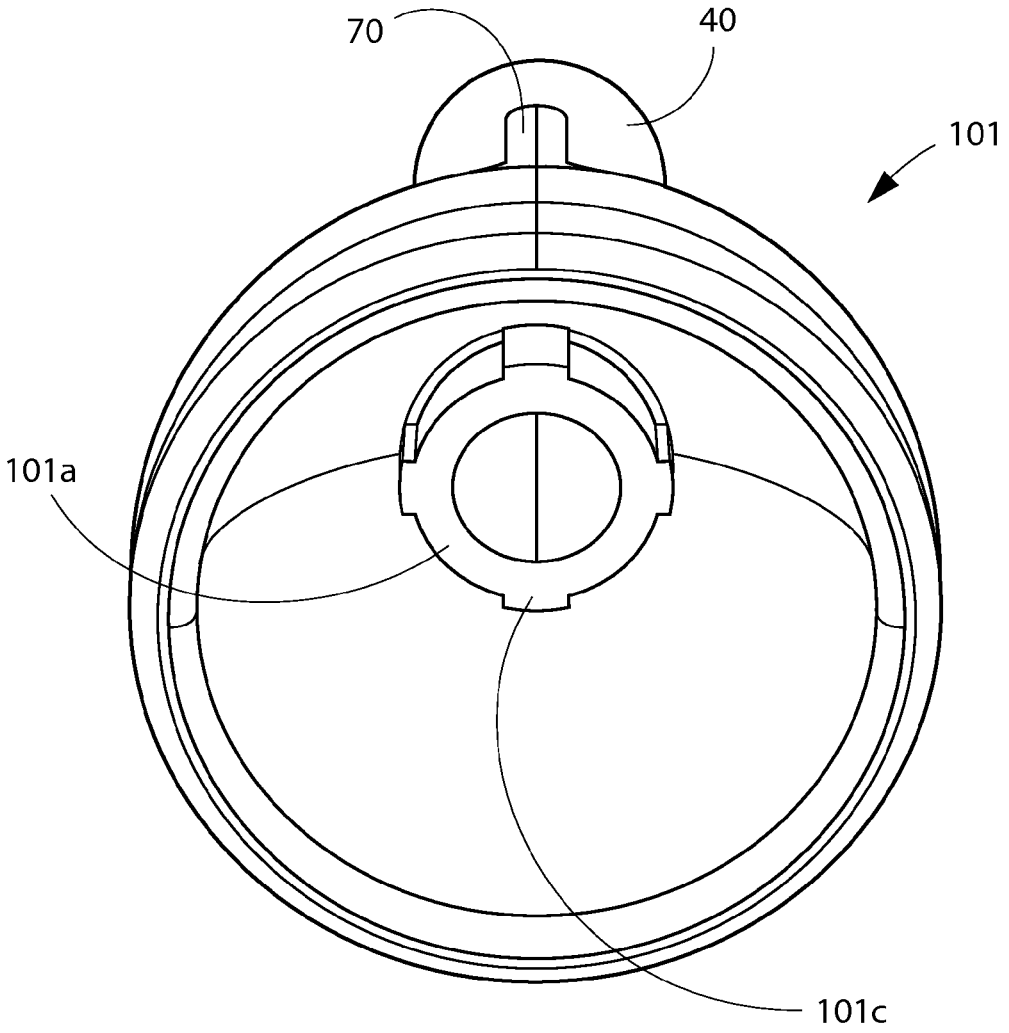
FIG. 10 is a perspective view of the underside of the spout of the embodiment shown in FIG. 1.

Upper portion 101 generally comprises a water spout 40 and a socket 42. As shown in FIGS. 3-6, socket 42 fits over the partial ball 44 of lower portion 106. The joint formed by partial ball 44 and socket 42 advantageously allows the water spout 40 to rotate in a variety of angles and/or through an arc. Lubrication may optionally be disposed between socket 42 and partial ball 44 to permit water spout 40 to move more freely. Upper portion 101 also comprises an internal ring 101*a* (FIGS. 5, 10) which projects into the interior of socket 42.

Figure 11:
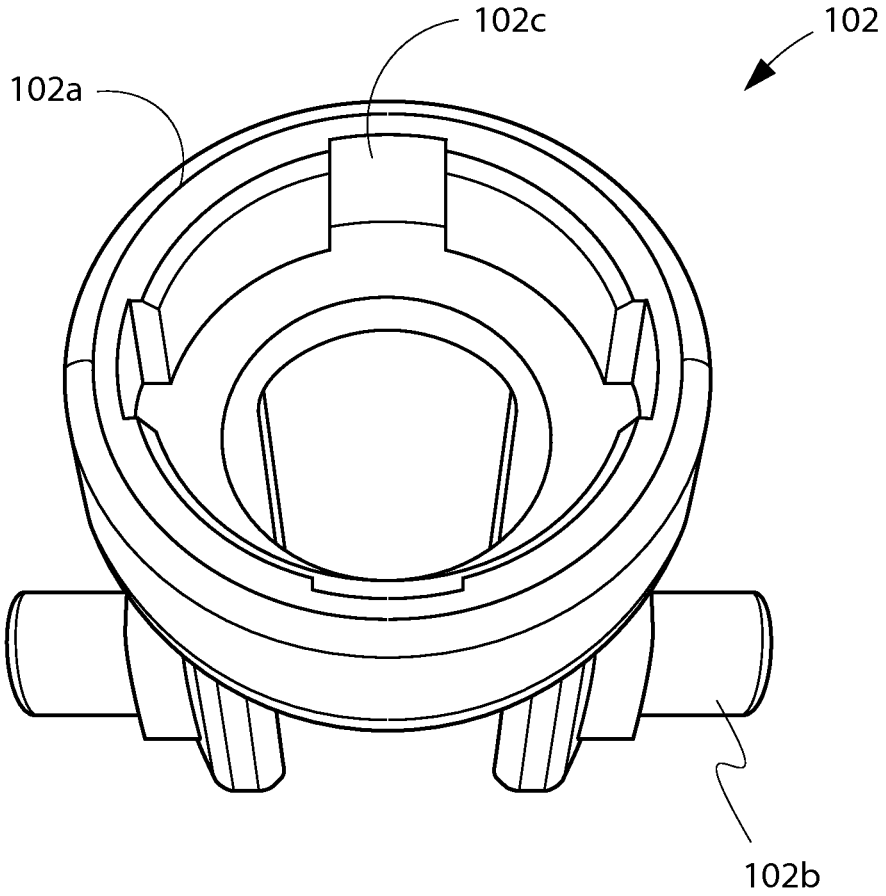
FIG. 11 is a perspective view of the top of an upper connector in the embodiment of FIG. 1.

Upper connector 102 fits inside the socket 42 of upper portion 101. Upper connector 102 comprises a ring 102*a* (FIGS. 5, 7, 11) which has a plurality of slots or grooves 102*c* disposed in the inner circumference of ring 102*a*. These slots or grooves 102*c* advantageously mate with ribs or notches 101*c* disposed on the outer circumference of ring 101*a* (FIG. 5) of the upper portion 101. As described in more detail below, the mating of the ribs or notches 101*c* on ring 101*a* with the slots or grooves 102*c* of ring 102*a* allows for the rotational motion of the upper portion 101 to be transferred to the upper connector 102 and to the valve 52. In alternative embodiments, ring 102*a* of upper connector 102 comprises ribs or notches (not pictured) which engage corresponding slots or grooves (not pictured) disposed within ring 101*a*.

Upper connector 102 further comprises two downward projecting portions 102*d*, each of which has a peg 102*b* (FIG. 7). Each peg 102*b* is adapted to fit into a corresponding hole 103*a* (FIG. 7) on the lower connector 103. The lower connector 103 also has two pegs 103*b* (FIG. 7) which fit into corresponding slots 104*a* on middle portion 104. The two pegs 102*b* of upper connector 102 create a first axis of rotation and the two pegs 103*b* of lower connector 103 create a second axis of rotation which is perpendicular to the first axis of rotation. Accordingly, these respective axes of rotation act cooperatively to permit the spout 40 of upper portion 101 to move through 360 degrees of rotation and a variety of angles of inclination.

Middle portion 104 comprises a partial ball 104*b* which fits inside partial ball 44 of lower portion 106. Optional lubrication may be disposed between partial ball 104*b* and partial ball 44. With or without such lubrication, partial ball 104*b* may rotate within partial ball 44. That is, partial ball 104*b* can rotate about an axis of rotation defined from the lower end 20 to the upper end 21 of the adjustable water jet device 10.

Middle portion 104 further comprises one or more projecting portions 104*c* which project in a downward direction. Each downward projecting portion 104*c* may contain one or more optional holes 104*d* to reduce the weight and amount of material necessary to construct the middle portion 104. The downward projecting portions 104*c* are advantageously adapted to fit snugly in the space between two neighboring laterally projecting portions 105*a* of valve portion 105. As described in more detail below, the downward projecting portions 104*c* work cooperatively with the laterally projecting portions 105*a* of valve portion 105 to translate rotational motion from the middle portion 104 to the valve portion 105.

Lower portion 106 generally comprises partial ball 44, central shaft 46, nut 48, and threaded portion 50. Threaded portion 50 (FIG. 7) has internal threads 56 adapted for engaging the external threads 105*b* of valve portion 105.

Threaded portion 50 also has external threads 51 adapted for engaging the internal threads 29 (FIG. 4) of upper channel portion 28 of housing 12. Accordingly, central valve section 14 can be fastened to the housing by screwing the threaded portion 50 of the central valve section 14 into the upper channel portion 28 of housing 12. Conversely, central valve section 14 can be removed from the housing 12 by unscrewing threaded portion 50 from the upper channel portion 28 of housing 12.

Nut 48 preferably forms an integral part of central shaft 46 or is affixed to central shaft 46 such that the rotation of nut 48 will cause central shaft 46, lower portion 106, and the entire central valve section 14 to rotate along with nut 48. Nut 48 may be a hexagonal nut or any other suitable shaped nut. As described in more detail below, the multipurpose tool 16 can be used in conjunction with nut 48 to aid in screwing the central valve section 14 to the housing 12 or unscrewing the central valve section 14 from the housing.

Valve portion 105 (FIG. 7) generally comprises a valve 52 with a tip 58 and an upper portion comprising a plurality of laterally projecting portions 105*a*. The embodiment shown in FIG. 7 has four laterally projecting portions 105*a*, each of which is disposed at a 90 degree angle from the neighboring laterally projecting portion 105*a*. As described above, each laterally projecting portion 105*a* comprises external threads 105*b* adapted for engaging the internal threads 56 of the threaded portion 50 of lower portion 106 of central valve section 14.

As shown in FIGS. 3-6, valve portion 105 is generally situated such that valve 52 is disposed in central channel portion 26 of housing 12. The laterally projecting portions 105*a* of valve portion 105 are disposed within the threaded portion 50 of lower portion 106 of central valve section 14. An optional molded ring 107 (FIG. 7) is preferably disposed in upper channel portion 28 (FIGS. 4-5) just above flange 27. The molded ring 107 preferably comprises a molded plastic ring and acts as a seal between flange 27 and the threaded portion 50 (FIG. 7) of lower portion 106, thus preventing water from leaking out of the upper channel portion 28 (FIGS. 4-5) and into the main cavity of housing 12. As described below, molded ring 107 may also act as a seat upon which valve 52 may come to rest, thus preventing any water from flowing through the water jet device 10.

Advantageously, using multipurpose tool 16 as disclosed herein, valve 52 can be moved relatively towards the first end 20 of the adjustable water jet device 10 by rotating valve portion 105 in one direction. Valve portion 105 can be moved towards the second end 21 of the adjustable water jet device 10 by rotating the valve portion 105 in the other direction. As valve 52 is moved from the first end 20 toward the second end 21, the pressure of the water moving through the adjustable water jet device 10 is increased and the total volume of water moving therethrough is decreased. Conversely, as valve 52 is moved from the second end 21 towards the first end 20, the pressure of the water moving through the water jet device 10 is decreased and the total volume of water moving therethrough is increased. Because multipurpose tool 16 preferably comprises a central hollow cavity 62 (FIGS. 5-6), water can continue to flow through the adjustable water jet 10 and the multipurpose tool 16 while valve 52 is adjusted using the multipurpose tool 16, as shown in FIG. 8.

In alternate embodiments, valve 52 may be fixed in place and not capable of being moved in either direction towards the first end 20 or second end 21 of the adjustable water jet device 10. In some embodiments, valve 52 may be situated substantially inside the lower threaded portion 50 of the lower portion 106 of central valve section 14, with only the lower tip 58 of valve 52 protruding from the lower threaded portion 50.

Multipurpose tool 16 can be used in conjunction with the adjustable water jet device 10 to control the direction of the arc or angle of the water jet flowing out of the device 10 without turning off the water supply to the device 10. Multipurpose tool 16 can also be used as a wrench to remove the central valve section 14 from the housing 12. Finally, multipurpose tool 16 can be used to adjust valve 52 and the water flow rate and water pressure through the water jet device 10, thus controlling the height of the arc of water emanating from the adjustable water jet device 10.

With particular reference to FIGS. 2-6, the multipurpose tool 16 preferably comprises a form having a central hollow cavity 62. A first grip 64 surrounds the upper portion of the central hollow cavity 62 and allows a person to grip the tool 16 and manipulate it by hand. A hollow lower shaft 66 (FIGS. 3-4) is shaped so it can mate with the upper end of water spout 40 of the upper portion 101 of the central valve section 14. Preferably, the inner diameter of the lower shaft 66 is slightly larger than the outer diameter of the water spout 40 so as to allow the lower shaft 66 to fit snugly over the water spout 40.

Lower shaft 66 preferably contains one or more slots 68 (FIGS. 3-4) which mate with grooves 70 (FIGS. 3-4, 7) protruding from water spout 40. Advantageously, the slots 68 and grooves 70 allow the multipurpose tool 16 to manipulate the orientation of the water spout 40. As discussed previously, water spout 40 can be manipulated in 360 degrees with a variety of angles of inclination because of the perpendicular axes of rotation created by upper connector 102 and lower connector 103, respectively.

Further, as shown in FIG. 8, the angle and direction of water spout 40 can be manipulated using the multipurpose tool 16 while water is still flowing out of water spout 40, as water can flow through central hollow cavity 62 when multipurpose tool 16 is attached to water spout 40. That is, a person can grip the outside of first grip 64 and use the multipurpose tool 16 to change the angle or direction of the water spout 40 without interfering with the water flowing therethrough.

Multipurpose tool 16 can be also be used to adjust valve 52 and the water flow rate and water pressure through the water jet device 10. As shown in FIGS. 3-6, the slots 68 of multipurpose tool 16 are configured to mate with the grooves 70 of water spout 40. When the multipurpose tool 16 is rotated in a preferably clockwise direction (with respect to an axis of rotation from the upper end 21 to the lower end 20 of housing 12), the slots 68 of multipurpose tool 16 will engage the grooves 70 of water spout 40, thus causing water spout 40 and the entire upper portion 101 (FIG. 7) to rotate in a clockwise direction. In turn, the notches disposed in the internal ring 101*a* (FIGS. 5, 10) of upper portion 101 will engage the slots in ring 102*a* (FIGS. 5, 11) of the upper connector 102 (FIG. 7), thus causing the upper connector 102 to rotate in a clockwise fashion. This rotating motion will further be translated by pegs 102*b* to the holes 103*a* of upper connector 103, and thence to the pegs 103*b* of upper connector 103 and to the slots 104*a* of middle portion 104. In turn, middle portion 104 will rotate in a clockwise manner and translate such motion to partial ball 104*b* and downward projecting portions 104*c*. Finally, downward projecting portions 104*c* will translate the clockwise motion to the laterally projecting portions 105*a* of valve portion 105. In turn, the external threads 105*b* will engage the internal threads 56 of lower portion 106, thus allowing the entire valve portion 105 (and hence valve 52) to move towards the first end 20 of housing 12. In such a manner, the water pressure moving through the water jet device 10 will be reduced while the flow rate will be increased.

The multipurpose tool 16 can be rotated in the opposite direction (preferably counterclockwise) to move the valve 52 in the opposite direction, namely towards the second end 21 of housing 12. This will cause the water pressure in the water jet device 10 to increase while the water flow rate is decreased. Eventually, valve 52 may be moved sufficiently far towards the second end 21 of housing 12 such that the wide portion of valve 52 may come to rest upon molded ring 107, thus preventing any water from flowing through the water jet device 10.

Finally, the multipurpose tool 16 can also be reversed in orientation and used as a wrench to remove the central valve section 14 from the housing 12 of the adjustable water jet device 10. With particular reference to FIGS. 3-6, a wrench portion 72 of the multipurpose tool 16 is shown. The wrench portion 72 is advantageously shaped to match the shape of the nut 48 of the central valve section 14. The central hollow cavity 62 of the multipurpose tool 16 must be large enough so the multipurpose tool 16 can fit over spout 40, socket 42, and partial ball 44 of the central valve section 14. A flange 74 (FIGS. 2, 7) allows for the multipurpose tool to come to rest on nut 48 when the tool is used as a wrench.

To remove the central valve section 14, removable cap 34 is first removed from the housing 12. The multipurpose tool 16 is then inserted into the upper end 21 of the housing with the wrench portion 72 being inserted first. The wrench portion 72 is maneuvered so the wrench portion 72 fits over nut 48. Thereafter, the multipurpose tool 16 can be rotated (preferably counterclockwise) so as to disengage the threaded portion 50 (FIG. 7) of central valve section 14 from the internal threads 29 of the upper channel portion 28 of housing 12. An optional second grip 76 provides for additional torque to disengage the central valve section 14. Multipurpose tool 16 can also be rotated in the other direction (preferably clockwise) to screw the central valve section 14 back into housing 12.

Accordingly, while the invention has been described with reference to the structures and processes disclosed, it is not confined to the details set forth, but is intended to cover such modifications or changes as may fall within the scope of the following claims.

What is claimed is:

1. An adjustable water jet device comprising:

a. a housing; and b. a central valve section comprising an adjustable spout, a valve, and a threaded portion capable of threadably engaging said housing;

wherein said adjustable spout is adapted to engage with a hollow tool for manipulating the orientation of said adjustable spout while water flows through said adjustable spout and said hollow tool, and wherein said adjustable spout comprises one or more grooves, each groove adapted to engage a corresponding slot of said hollow tool, and wherein said hollow tool comprises a shaft, said shaft being adapted to fit around the outside of said adjustable spout.

2. The adjustable water jet device of claim 1 wherein said hollow tool is removable from said adjustable spout.

3. The adjustable water jet device of claim 1 wherein said adjustable spout further comprises a socket, wherein said threaded portion further comprises a partial ball, and wherein said socket is adapted to fit over said partial ball.

4. The adjustable water jet device of claim 3 wherein said central valve section further comprises:

an upper connector comprising a ring, one or more downward projecting portions, and one or more pegs attached to each of said one or more downward projecting portions;

a lower connector comprising a ring with one or more holes disposed therein and one or more pegs disposed therein; and a middle portion comprising a partial ball and one or more downward projecting portions.

5. The adjustable water jet device of claim 4 wherein said socket further comprises an internal ring disposed within the interior of said socket, wherein said internal ring of said socket is adapted to engage the ring of said upper connector and translate any rotational motion from said socket to said upper connector.

6. The adjustable water jet device of claim 5 wherein said internal ring of said socket comprises one or more notches adapted to engage one or more slots disposed within the ring of said upper connector.

7. The adjustable water jet device of claim 6 wherein said pegs of said upper connector are adapted to engage the holes of said lower connector and translate any rotational motion from said upper connector to said lower connector.

8. The adjustable water jet device of claim 5 wherein said ring of said upper connector comprises one or more notches adapted to engage one or more slots disposed within the internal ring of said socket.

9. The adjustable water jet device of claim 8 wherein the partial ball of said middle portion comprises one or more slots, each of said one or more slots being adapted to engage a peg of said lower connector.

10. The adjustable water jet device of claim 9 wherein said valve further comprises laterally projecting portions, and wherein said threaded portion comprises external threads and internal threads, said external threads being adapted to engage threads in said housing, and said internal threads being adapted to engage threads on the laterally projecting portions of said valve.

11. The adjustable water jet device of claim 10 wherein the downward projecting portions of said middle portion are adapted to engage the laterally projecting portions of said valve.

12. The adjustable water jet device of claim 1 wherein said hollow tool further comprises a wrench portion, wherein said threaded portion further comprises a nut, wherein said wrench portion is adapted to engage said nut, and wherein said threaded portion is removable from said housing.

13. The adjustable water jet device of claim 1 wherein said adjustable spout is adapted to manipulate the position of said valve with respect to said housing.

14. An adjustable valve device comprising:

a. an upper portion comprising a hollow spout and a socket;

b. an upper connector comprising a ring, one or more downward projecting portions, and one or more pegs attached to each of said one or more downward projecting portions;

c. a lower connector comprising a ring with one or more holes disposed therein and one or more pegs disposed therein;

d. a middle portion comprising a partial ball and one or more downward projecting portions;

e. a lower portion comprising a partial ball and a threaded portion; and f. a valve portion comprising a valve and one or more laterally projecting portions.

15. The adjustable valve device of claim 14 wherein said upper portion further comprises an internal ring disposed within the interior of said upper portion, wherein said internal ring of said upper portion is adapted to engage the ring of said upper connector and translate any rotational motion from said upper portion to said upper connector.

16. The adjustable valve device of claim 15 wherein said internal ring of said upper portion comprises one or more notches adapted to engage one or more slots disposed within the ring of said upper connector.

17. The adjustable valve device of claim 15 wherein said ring of said upper connector comprises one or more notches adapted to engage one or more slots disposed within the internal ring of said upper portion.

18. The adjustable valve device of claim 14 wherein said pegs of said upper connector are adapted to engage the holes of said lower connector and translate any rotational motion from said upper connector to said lower connector.

19. The adjustable valve device of claim 14 wherein the partial ball of said middle portion comprises one or more slots, each of said one or more slots being adapted to engage a peg of said lower connector.

20. The adjustable valve device of claim 14 wherein said threaded portion of said lower portion comprises external threads and internal threads, said external threads being adapted to engage threads in a housing, and said internal threads being adapted to engage threads on the laterally projecting portions of said valve portion.

21. The adjustable valve device of claim 14 wherein the socket of said upper portion is adapted to fit over the partial ball of said lower portion.

22. The adjustable valve device of claim 14 wherein the downward projecting portions of said middle portion are adapted to engage the laterally projecting portions of said valve portion.

* * * * *